United States Patent [19]

Klocke et al.

[11] Patent Number: 4,561,344

[45] Date of Patent: Dec. 31, 1985

[54] ELECTRO-FLUIDIC CONTROL DEVICE

[75] Inventors: Harald Klocke; Uwe H. Thomsen, both of Malente, Fed. Rep. of Germany

[73] Assignee: H. Kuhnke GmbH KG, Malente, Fed. Rep. of Germany

[21] Appl. No.: 582,523

[22] Filed: Feb. 22, 1984

[30] Foreign Application Priority Data

Feb. 25, 1983 [DE] Fed. Rep. of Germany ..... 3306588

[51] Int. Cl.[4] ..... F15B 13/16

[52] U.S. Cl. ..... 91/358 A; 91/47; 91/394; 91/417 R; 91/459; 91/DIG. 4; 137/625.64; 251/129.15

[58] Field of Search ..... 137/625.64; 251/129; 91/358 A, 337, DIG. 4, 47, 417 R, 459

[56] References Cited

U.S. PATENT DOCUMENTS 558,256 4/1896 Bush ..... 137/625.64
3,013,531 12/1961 Mueller et al. ..... 91/4
3,646,851 3/1972 Mohri ..... 137/625.64
3,856,047 12/1974 Takayoma ..... 137/625.64

*Primary Examiner*—Paul E. Maslousky
*Attorney, Agent, or Firm*—Balogh, Osann, Kramer, Dvorak, Genova & Traub

[57] ABSTRACT

A device of this nature incorporates at least one control piston displaceable within a casing, the casing having at least one venting nozzle authorizing the insertion of the piston into one of its possible operating positions, which nozzle may be shut off by means of an electromagnetically operated closing device for preparation of the outward displacement of the piston out of this operating position. To accomplish that such devices may manage with a substantially reduced electrical battery power for their electromagnetic closing device, a permanent magnet is provided which co-operates with a ferromagnetic member of the closing device, in such manner that the closing device continues to be held in its closing position while the control piston is being reversed, although the supply of electrical power to the closing device had already been turned off.

9 Claims, 8 Drawing Figures

ELECTRO-FLUIDIC CONTROL DEVICE

BACKGROUND OF THE INVENTION

The present invention relates to electro-fluidic control devices comprising at least one fluidic control piston displaceable within a casing, the casing comprising at least one venting nozzle arranged to drive the control piston in one direction into a first operating position and a closure device arranged to shut off the venting which may be shut off by means of a nozzle prior to movement of the control piston out of the first operating position, an electromagnet being arranged to displace the closure device towards the venting nozzle.

Fluid-operated valves are known, which comprise an anticipatory control system containing a closure device and an electromagnet system actuating the closure device. The electromagnet system is supplied with electrical power throughout the closing operation and throughout the period of the closed condition of the closure device, so that a comparatively large consumption of electric power is operative for supplying the anticipatory control system. Operation of the electromagnet system other than from a mains supply, for example by means of electrical battery, is considerably restricted for this reason.

An object is to provide a device of the nature specified, which may be operated economically by means of electrical batteries.

SUMMARY OF THE INVENTION

In a device of the kind specified according to the invention the closure device is arranged to be held in the closed position by means of a permanent magnet and the electromagnet is de-energised, once the closure device is situated in the closed position and is reset automatically during the displacement of the control piston to free the venting nozzle, the magnetic coupling between the closure device and the permanent magnet, which is preferably connected to the control piston, being broken for this purpose.

As a result, the electrical power consumption required to operate the closure device is reduced substantially, so that operation of the device independent of a mains supply may be performed economically by means of electrical batteries. The electromagnetic system may be de-energised, at the latest after the venting nozzle of the device is closed, so that the permanent magnet then continues to hold the closure device shut whilst the control piston of the device travels to its operating position. When that position is reached, the force of the permanent magnet no longer suffices to hold the closure device shut, so that the latter opens again being suitably biased to an open condition. The piston then remains in its new position until it receives the fluidic reset pulse. Since the electromagnet is energise solely during closing movement of the closure device. It is apparent that the saving in electrical operating power is substantial and it has been found that a device according to the invention may perform 50 to 70 million operating actions on one commercial electrical battery, so that an economic operation is obtained in this way. The invention may moreover be accomplished in an uncomplicated manner and at low costs in respect of construction and production technology.

BRIEF DESCRIPTION OF THE DRAWINGS

In order that the invention may be more clearly understood reference will now be made by way of example to the accompanying drawings, in which.

DETAILED DESCRIPTION OF THE DRAWINGS

Figure 1:
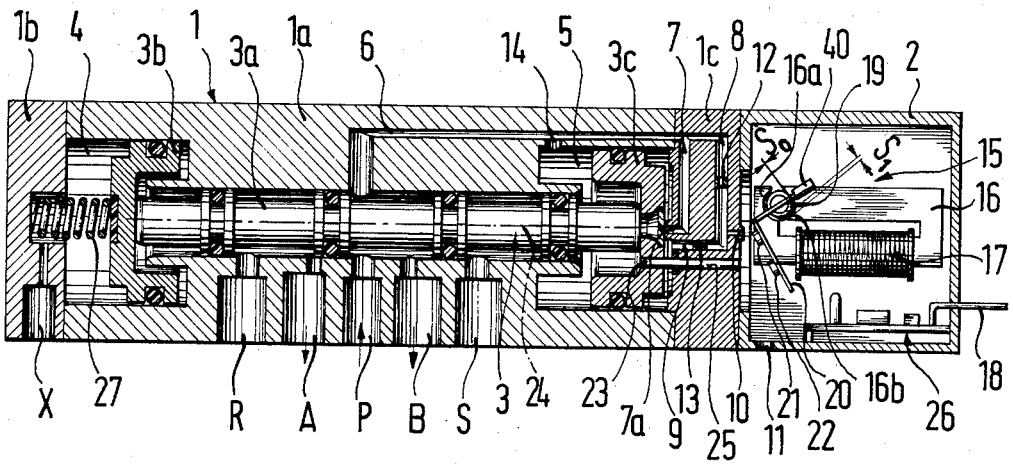
FIG. 1 is a longitudinal cross-section of a first embodiment of the invention.

Referring now to FIG. 1, the first embodiment in the form of a valve comprises a principal casing 1 consisting of a body member 1*a* having end covers 1*b* and 1*c*, and a secondary casing 2 at one end. The body member 1*a* has situated within it an axially displaceable control piston 3, which comprises a central section 3*a* resembling a piston rod, and two piston-shaped end sections 3*b* and 3*c*. The piston sections 3*b*, 3*c* are axially displaceable in cylindrical piston chambers 4 and 5, respectively. The body member 1*a* is provided with a main fluid inlet P, two outlets A and B as well and with the two venting outlets R and S. The outlets A and B are arranged on opposite sides of the inlet P and the venting outlets R and S adjacent respective outlets A and B and remote from the inlet P. The inlet and outlets are interconnected by appropriate positions of the control piston 3, in known manner by axial movement of the piston 3.

A principal passage 6 leads from a space receiving the central section 3*a* of the control piston 3 to the casing cover 1*c*, at which the principal passage is divided into a first branch passage 7 having a nozzle 7*a* opening into a piston chamber 5 so that the terminal piston section 3*c* may be acted upon by means of pressure fluid for the purpose of displacing the control piston 3, as will be described below, and a second branch passage 8. The cover 1*c* is provided with a third branch passage 9 which is in communication with the second branch passage 8 and with the piston chamber 5, and the two branch passages 8,9 are connected to a venting nozzle 10 in the casing cover 1*c*, which opens into the secondary casing 2, which casing is in communication with the atmosphere via an opening 11. So that fluid flowing out of the venting nozzle 10 is throttled, the branch passages 8 and 9 are equipped with throttle restrictors 12 and 13, respectively, on opposite sides of nozzle. The first branch passage 7 has no cross-sectional constriction apart from its nozzle 7*a*, so that substantially unthrottled fluid flows into the piston chamber 5 through this passage. The flow cross-section of the throttle restrictor 13 is smaller than the flow cross-section of the inlet nozzle 7*a* of the first branch passage 7, so that overpressure as compared to atmospheric is constantly available in the piston chamber 5 when the nozzles 7*a* and 10 are open and fluid pressure is applied.

The principal passage 6 is arranged to be in communication with the principal inlet P whatever the position of the control piston 3 and is also connected via a drilling 14 to the rear portion of the piston chamber 5 facing towards the rear side of the piston section 3*c*.

The secondary casing 2 situated at the righthand extremity of the casing 1 adjacent the end cover 1*c*, incorporates a closure device 15 for the venting nozzle 10 in the end cover 1*c*. This closure device incorporates an iron armature 16 and an armature coil 17 electrically supplied via conductor 18. The iron armature 16 contains an annular magnet 19 which is permanently diametrically magnetised, and which is housed between opposed approximately semi-circular and slightly mutually transversely offset recesses 16*a*,16*b* of the armature 16. The transverse offset of the recesses 16*a*,16*b* has the purpose of assuring that after de-energising the coil 17, the annular magnet 19 assumes one and the same specified position as the initial position if the coil 17 is operated with unchanging polarity, in view of its polarity and of its liability to assume a position of minimum air gap in relation to the armature recesses. In FIG. 1 the minimum air gap is denoted by So and the maximum air gap corresponding thereto, by S1.

The annular magnet 19 carries a hinged arm 20 which is formed with an L-shape having one limb carrying a closure member 21 for the venting nozzle 10 and a ferromagnetic member 22, and with the other limb connected to the annular magnet 19 having an extension equipped at its free end with a counterbalancing element 40. The counterbalancing element 40 assures that the pivot axis of the hinged arm 20 substantially coincides with the centre of the annular magnet 19 to secure a minimum rotational inertia for the annular magnet 19 and the hinged arm 20. The position illustrated for the annular magnet denotes the initial position of the hinged arm 20, to which it returns after the electrical coil 17 is de-energised and other conditions are fulfilled.

The iron core 16 is saturated magnetically when the coil 17 is supplied with current, and the annular magnet 19 is thereby being pivoted with the hinged arm 20, so that the closure member 21 shuts off the venting nozzle 10. In the case illustrated, the pivoting angle of the hinged arm 20 suitably amounts to between 30° to 45°. A pivoting angle of this value proved to be advantageous, although it is possible to utilise a pivoting angle of up to 90°. A pivoting angle exceeding 90° should preferably be avoided.

Once the hinged arm 20 has been pivoted, the iron or ferrite member 22 also bears on the casing cover 1*c* and is held fast by a permanent magnet 23 which is secured in the piston section 3*c*. The permanent magnet 23 comprises a rod-shaped member and extends axially parallel to the longitudinal axis 24 of the control piston 3, through a bore 25 in the casing cover 1*c*. The bore 25 incorporates a seal engaging the rod magnet, so that no fluid may escape to the outside from the piston chamber 5.

As a modification, it is also possible to proceed in such manner that the hinged arm 20 does not carry the ferrite member 22 as a separate component, but that a terminal portion of the hinged arm 20 itself is constructed as a ferromagnetic member. Furthermore, the hinged arm 20 is formed from non-magnetisable material. As a further alternative it is possible to install a permanent magnet on the hinged arm 20 instead of the ferrite member 22, and that a ferrite member or the like may then be installed on the piston section 3*c*. As a yet further modification, it is possible to replace the system described, which comprises the iron core 16 and the electrical coil 17, by a conventional hinged armature system, in which the hinged armature is counterbalanced and carries a ferromagnetic element which cooperates with the permanent magnet 23.

An electrical or electronic switching circuit 26 is provided to turn off the current to the electrical coil 17, once the hinged arm 20 is situated in the closing position in which the venting nozzle 10 is shut off by the closing member 21. This switching circuit may also be so arranged that the supply of current to the electrical coil 17 is turned off before the hinged arm 20 is wholly placed in its closing position. This is possible because the attractive force of the permanent magnet 23 placed in the terminal position with the piston section 3*c* shutting off the nozzle 7*a* of the first branch passage 7, is already so great that the continued pivotal displacement of the hinged arm 20 is performed by the attraction of the ferrite member 22 fastened on the hinged arm. The period of energisation of the coil 17 may consequently be kept very short. The construction of the switching circuit 26 may for example be performed by a C-MOS technique, so that the intrinsic consumption of the switching circuit is reduced below the spontaneous discharge limit of a commercial alkaline or lithium battery supplying the coil 17.

In the example described above, only the right-hand end of the valve is equipped with a secondary casing 2 and the associated anticipatory control system. The left-hand extremity of the valve is merely equipped with an inlet X through which fluid is injected for resetting the control piston 3. In this example, the control piston 3 is present at its initial position, which is secured by a return spring 27. This spring bears on the casing cover 1*b* on the one hand, and on the other terminal piston section 3*b* on the other hand.

The valve described operates as follows. Let us assume that the control piston 3 is placed in its initial position is shown in FIG. 1, in which the terminal piston section 3*c* keeps the inlet nozzle 7*a* shut, between the first branch passage 7 and the piston chamber 5.

A fluid signal then passes via the inlet P into the body element 1*a*, a corresponding operating signal initially being transmitted onward via the outlet B. At the same time, a control signal is derived from this input signal, which passes through the principal passage 6 into the first branch passage 7 and the second branch passage 8. It also passes through the drilling 14 into the rear portion of the piston chamber 5. Since the force acting on the rear side of the piston section 3*c* is greater than the force acting on the piston section 3*c* via the first branch passage 7, the piston section 3*c* remains in its initial position illustrated. The auxiliary fluid present in the principal passage 6 thus flows from the second branch passage 8 into the atmosphere through the open venting nozzle 10 and the other opening 11 in the case of a pneumatic fluid.

If the control piston 3 is now to be reversed, the electrical coil 17 is energised, so that the magnetic flux in the iron core 16 causes a pivotal deflection of the annular magnet 19 and thus of the hinged arm 20, away from its initial position. The coil 17 is turned off again by means of the switching circuit 26 no later than when the arm 20 is situated in its closing position in which it shuts off the venting nozzle 10. The hinged arm 20 then tends to move back, but is prevented from doing so by the permanent magnet 23 of the piston section 3*c* which retains the ferrite member 22 of the hinged arm 20 and thereby holds the hinged arm in its closing position. The venting nozzle 10 then no longer allows outflow of fluid and full fluid pressure is exerted on the piston side appearing at the right in the drawings, via all the branch passages. Since a smaller force acts on the left-hand side of the terminal piston section 3*c* because of the central section 3*a* of the control piston 3, the control piston 3 as a whole is then displaced towards the left, thereby interrupting the connection P-B and establishing a new connection P-A. The operating fluid when flows out of the valve through the outlet A.

During this reversal, the permanent magnet 23 of the piston section 3*c* is equally displaced towards the left and moved so far from the ferrite member 22 of the hinged arm 20, that its magnetic force acting against the reset force of the closing device 15 is no longer adequate to hold the hinged arm in its closing position. The said reset force derives from the circumstance already referred to, that the diametrically magnetised annular magnet 19 re-assumes its position of minimum air gap So in view of its polarity and of the transversely offset recesses 16*a*, 16*b*, thereby causing return displacement of the hinged arm 20. The venting nozzle 10 is thus opened again.

Since the principal passage 6 remains in communication with the inlet P and thus carries pressure fluid, the latter passes into the branch passages 7 and 8. Since each of the branch passages 8 and 9 has a restrictor 12 and 13 respectively, the right-hand side of the terminal piston section 3*c* continues to be acted upon by pressure via the cross-sectionally larger nozzle 7*a* of the first unrestricted branch passage, although the venting nozzle 10 is open. The control piston 3 consequently retains its new position.

If, after a required period, the control piston 3 is to be reset again, a fluid signal is transmitted via the inlet X to the other terminal piston section 3*b*, so that the control piston 3 assumes its initial position again with the assistance of the return spring 27, into which the permanent magnet 23 had also mandatorily been displaced. The outlet A is shut off again in this position of the control piston, whereas the outlet B now carries the hydraulic pressure signal if the signal P is still operative.

Figure 2:
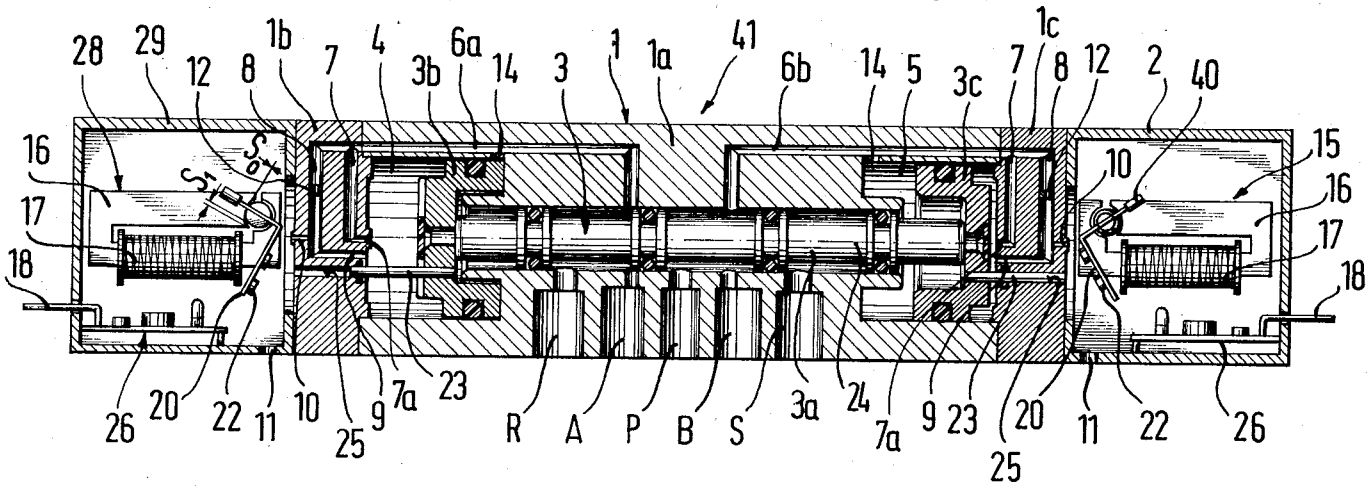
FIG. 2 is a view similar to FIG. 1 of a second embodiment.

Referring now to FIG. 2, the embodiment illustrated differs from the first example, inasmuch as a closure device 28 arranged for anticipatory control, is also installed on the other left-hand end of the valve illustrated, for reserting the control piston 3. This closure device is housed in another secondary casing 29, but is otherwise constructed in the same manner as the corresponding closing device 15 in the secondary casing 2 as described above in connection with FIG. 1, so that the same reference symbols are applicable to both closing devices. Another difference consists in that two principal passages 6*a*,6*b* are provided, which alternately carry an auxiliary fluid or are unpressurised. In the position illustrated, the right-hand principal passage 6*b* is connected to the inlet P, whereas the left-hand principal passage 6*a* is unpressurised. The cover element 1*b* is also modified to correspond with the cover element 1*c*, but neither of the two cover elements has any restrictor in its third branch passage 9. A restrictor, 13 FIG. 1, is not needed in this case, since the principal passages 6*a*,6*b* become unpressurised after reversal of the control piston 3. it is apparent from the structural form of the central section 3*a* of the control piston 3 as shown in the drawings, that the right-hand principal passage 6*b* becomes unpressurised upon reversing the control piston 3, whereas the left-hand principal passage 6*a* is acted upon by the pressure fluid from the inlet P. The valve 41 operates in a similar manner to the previously described valve, the left-hand closing device 28 then having to be actuated for resetting the control piston 3, so that the corresponding venting nozzle 10 is closed to act on the piston chamber 4 to displace the piston 3.

With reference to the embodiments shown in FIGS. 3 to 8, it is common to all that the piston section 3*c* of the control piston 3 has a central extension 31 passing through an axial bore 30 of the casing cover 1*b* in the initial position of the control piston, and that the extremity of the extension facing towards the closing device 15 is equipped with an insert 32 in the form of a permanent magnet. This insert 32 provided at the outer extremity of the extension and situated opposite to the member 22 of the lever 20, may according to FIGS. 3, 4 and 7, be provided as a compact central insert, but may also be constructed as a ring according to FIGS. 5, 6 and 8. Alternatively, the insert 32 or the extension 31 may be constructed as a ferromagnetic member in this terminal area and the permanent magnet may be provided on the lever 20.

Figure 3:
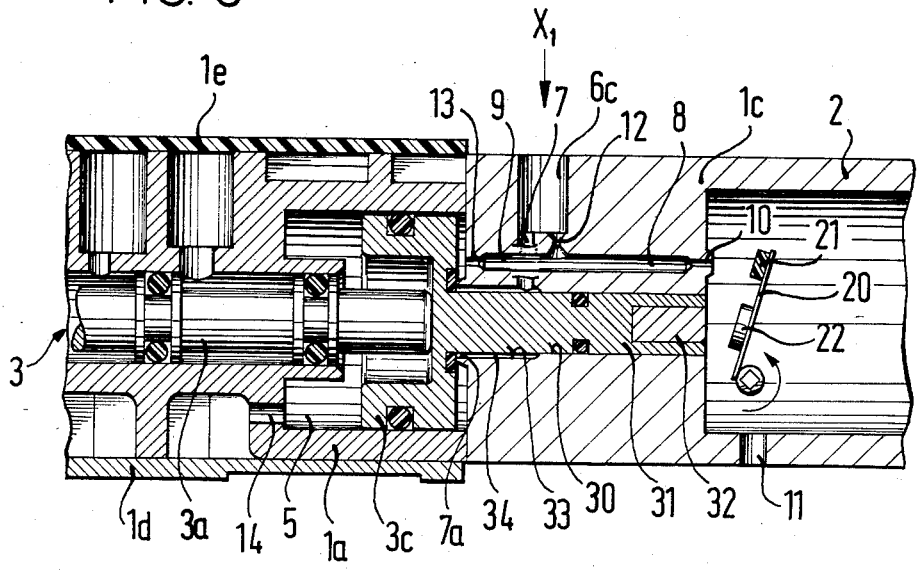
FIGS. 3 to 8 are fragmentary longitudinal sections of respective further embodiments of the invention.

In conjunction with the extension 31, the branch passages 7,8 and 9 may also be formed differently. To this end, FIG. 3 shows an alternative form of the section of the branch passage 7 which opens into the piston chamber 5. The axial bore 30 of the casing cover 1*c* is equipped with an enlargement 33 which is turned towards the piston section 3*c* of the control piston 3. Together with the corresponding section of the extension 31, this enlargement forms an annular space 34 which is in communcation with the first branch passage 7 as shown in FIG. 3, this annular space 34 being sealed off by contact of the piston section 3*c* against the cover 1*c*.

In operation, an auxiliary fluidic signal X1 is fed into the device from the outside, via the port 6*c*. The branch passages 7 and 8 lead from the port 6*c*, and are preferably formed by a common bore which extends parallel to the bore 30 of the cover 1*c* and is equipped with the nozzles 10 and 13 at opposite ends.

In the example of FIGS. 3 to 8, the closure device 15 is only partially illustrated to avoid cluttered illustration, and solely shows the lever 20 which carries the members 21 and 22. The closure device corresponds to what has been shown and described in connection with the embodiments of FIGS. 1 and 2.

The casing is also illustrated in modified form, in that the body element 1*a* is surrounded by peripherally installed coverplates 1*d* and 1*e*, which is not critical however.

Figure 4:
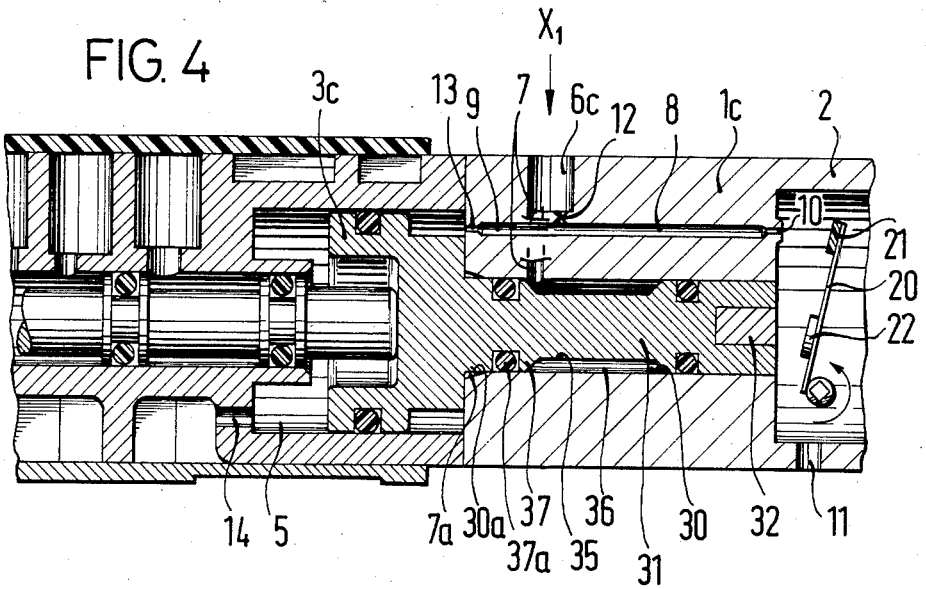

The embodiment according to FIG. 4 differs from that according to FIG. 3, inasmuch as the said annular space is formed in the extension 31. To this end, the extension 31 is produced with a smaller diameter along its central section 35, so that an annular space 36 is formed within the bore 30 of the cover 1*c* which is in communication with the first branch passage 7 in the position shown for the piston section 3*c*. Furthermore, the annular space 36 is sealed off against the piston chamber 5 in this position of the piston by the diametrically larger section 37 of the extension 31. The section 37 may comprise a conventional O-ring seal 37*a* within a groove for sealing purposes. It is appropriate moreover for the extremity of the bore 30 facing towards the chamber 5 to be equipped with a flared portion 30*a* which facilitates the insertion of the O-ring 37*a* into the bore. Once the piston 3*c*, 31 has travelled toward the left from the initial position, the passage 7 is in communication with the front section of the chamber 5 via the annular space 36.

Figure 5:
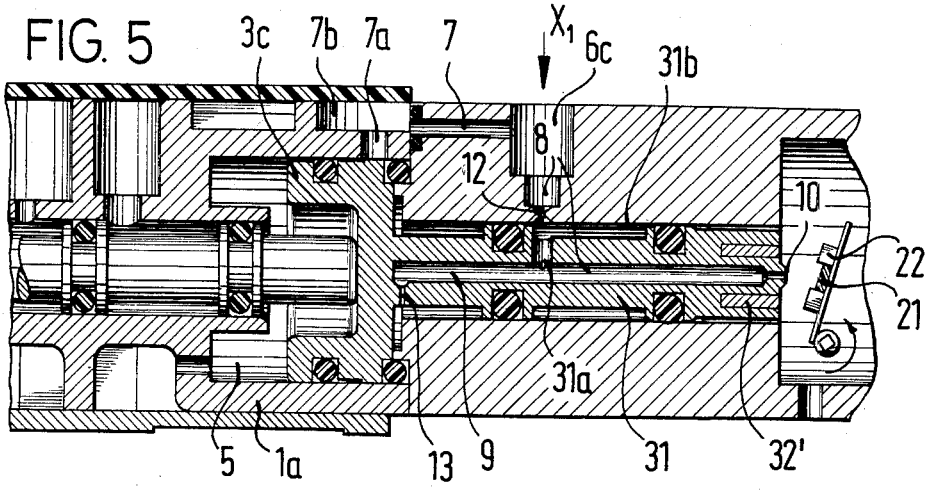

The embodiments according to FIGS. 5, 6, 7 and 8 differ from the embodiments according to FIGS. 3 and 4, inasmuch as other paths are selected for the branch passages 7 and 9. FIG. 5 shows that the third branch passage 9 is formed as a central bore extending axially within the extension 31, which at its extremity facing towards the closing device 15 merges into the venting bore 10 and at its other extremity is in communication with the other restrictor 13. According to FIG. 5, the said central bore extends as far as the piston section 3*c*, so that the additional restrictor leads into the front section of the piston chamber 5. Between the two extremities of the central bore, the extension 31 has a transverse bore 31*a* and a peripheral groove 31*b*, the central bore comprising the third branch passage 9 being in communication via the bore 31*a* and groove 31*b* with the second branch passage 8.

Figure 6:
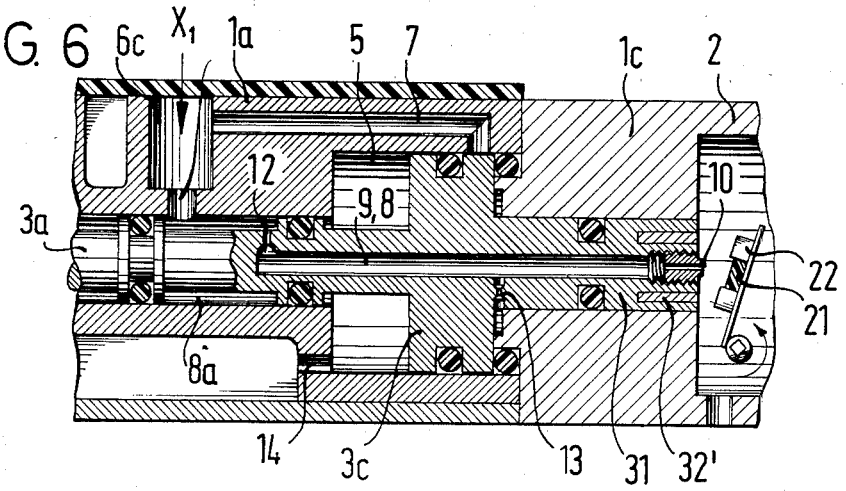

The embodiment of FIG. 6 deviates from the embodiment of FIG. 5, inasmuch as the extension 31, the piston section 3*c* and the central section 3*a* of the control piston 3 jointly form one unit, and that the central bore incorporating the third branch passage 9 extends into the said central section 3*a*. An additional wide peripheral groove 8*a* provided in the central section 3*a* forms a section of the second branch passage 8, and this section is in communication with the centrally extending bore via the other restrictor 12. The other restrictor 13 is installed in the extension 31, in such manner that it establishes a connection between the third branch passage 9 and the front section of the piston chamber 5.

Figure 7:
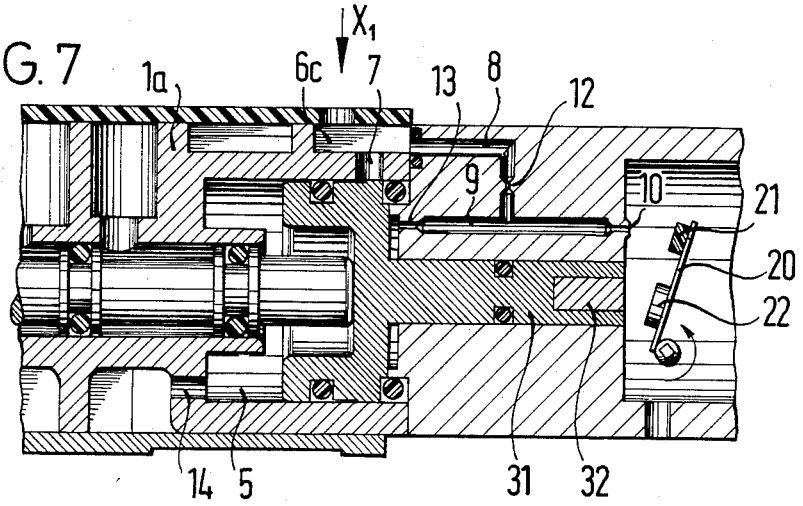

Another feature of the embodiments of FIGS. 5, 6 and 7 consist in that the first branch passage 7 opens into the front section of the piston chamber 5 at a different point, namely at a peripheral point of the chamber 5, as clearly apparent from the figures.

Figure 8:
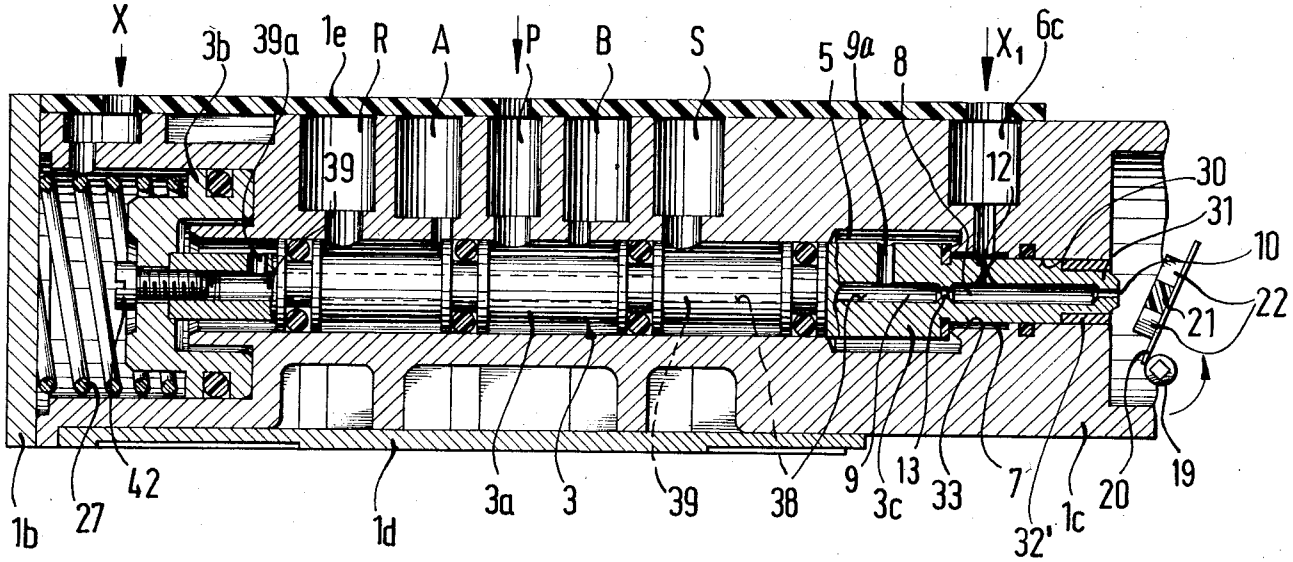

FIG. 8 shows another embodiment which has a simplified structure and may be produced very economically. An essential feature consists in that the piston section 3*c* and thus the corresponding piston chamber 5 as well, may be constructed in greatly reduced form. In this connection, FIG. 8 shows that the section 3*c* substantially corresponds to the central piston section 3*a* in diameter. Furthermore, the piston section 3*c*, the extension 31 and the central section 3*a* conjointly form one unit. The other piston section 3*b* is joined to this unit by means of a screw 42.

Furthermore, the said unit is equipped with an axially extending central bore 38 which forms the second and third passages 8 and 9 and a fourth passage 30. The passages 9 and 39 are in communication via lateral bores 9*a* and 39*a* respectively with the chamber 5 and with the rear side of the other piston section 3*b*, as apparent from FIG. 8. In this case too, the extremity of the central bore 38 turned towards the closing device 15 comprises the venting aperture 10. To form the first branch passage 7, the axial bore 30 in the extension 31 is also equipped with an enlargement 33 which in co-operation with the extension 31 forms an annular space which is sealed off by the terminal piston section 3*c*.

The examples of embodiment according to FIGS. 3 to 8 have advantages in respect of production technology, so that they may be produced at low cost, and they operate in similar manner to the examples according to FIGS. 1 and 2.

Apart from the advantages listed in the foregoing, it should also be stated that the examples of embodiment described may be placed in operation in combination with microprocessors, since complex control units have to be operated independently of a mains supply and in an isolated manner in this sphere. Another advantage is the uncomplicated structure for the fluidic components, since there is no need for very close fitting tolerances during production.

The novel features may be utilised particularly advantageously in combination with valves of the nature in question. It is also possible however to endow other fluidically controllable devices with the corresponding features, e.g. operating cylinders.

What we claim is:

1. An electro-fluidic control device, comprising at least one fluidic control piston displaceable within a casing, the casing having at least one venting nozzle arranged to drive the control piston in one direction into a first operating position, and a closure device arranged to shut off the venting nozzle prior to movement of the control piston out of the first operating position, said closure device being at least partially displaced into a closed position by means of an electromagnet, the closure device is arranged to be held in the closed position by means of a permanent magnet coupled to said control piston, means for deenergizing said electromagnet once the closure device is closed, and means for resetting said electromagnet automatically during the displacement of the control piston to open the venting nozzle, said control piston breaking the magnetic coupling between the closure device and the permanent magnet.

2. A device according to claim 1, wherein the permanent magnet is constructed as a rod-like element secured on the control piston axially parallel to its axial displacement, a non-magnetic casing cover has a corresponding axially parallel bore for reception of the permanent magnet, and that the closure device has a magnetic member reacting to the permanent magnet.

3. A device according to claim 1, wherein the closure device comprises a hinged arm which is equipped with a closure member to close the venting nozzle.

4. A device according to claim 3, wherein the hinged arm of the closing device is counterbalanced.

5. A device according to claim 3, wherein the pivoting angle of the hinged arm is smaller than 90°.

6. A device according to claim 3, wherein the hinged arm is secured to an annular permanent magnet which is permanently magnetized diametrically, and the permanent magnet is held in pivotally movable manner in approximately semi-circular recesses transversely offset a little with respect to each other in an armature core of said electromagnet bearing an electrical coil.

7. A device according to claim 6, wherein said deenergizing means includes an electronic switching circuit for limiting the period of energization of said electrical coil.

8. A device according to claim 1, comprising a principal duct in said casing for conveying an auxiliary fluid at least to one control piston section, wherein the principal duct is divided into a first unrestricted branch passage and a second branch passage equipped with a restrictor, the first branch passage leads via an inlet nozzle closable by means of the control piston into a front portion of a piston chamber containing the piston section of the control piston, and the second branch passage has connected to it a third branch passage which is in communication on the one hand with said front portion of the piston chamber and on the other hand together with the second branch passage downflow of the restrictor with the venting nozzle.

9. A device according to claim 8, wherein the third branch passage has another restrictor facing towards said front portion of the piston chamber, wherein the flow cross-section of said another restrictor is smaller than that of the inlet nozzle of the first branch passage opening into the piston chamber.

* * * * *